US005964642A

United States Patent [19]

Fildan

[11] Patent Number: 5,964,642

[45] Date of Patent: Oct. 12, 1999

[54] SHOULDER STRAP CONNECTOR FOR BRASSIERES, LINGERIE AND BATHING SUITS

[76] Inventor: Gerhard Fildan, Dr. Körner Str. 4, A-2521 Trumau, Austria

[21] Appl. No.: 08/967,711

[22] Filed: Nov. 10, 1997

[51] Int. Cl.[6] ..... A41C 3/00

[52] U.S. Cl. ..... 450/86; 2/323

[58] Field of Search ..... 2/300, 304, 305, 2/308, 310, 311, 312, 313, 314, 315, 316, 317, 318, 319, 320, 321, 322, 323, 324, 325, 326, 327, 328, 329, 330, 338, 155, 157, 156; 24/199, 312, 313, 310; 450/86–89

[56] References Cited

U.S. PATENT DOCUMENTS 506,494 10/1893 Harrison .
2,123,984 7/1938 Baer .

*Primary Examiner*—Gloria Hale
*Attorney, Agent, or Firm*—Herbert Dubno

[57] ABSTRACT

A shoulder strap connector for a garment has a first oval or circular member connected to one of the shoulder straps and a second oval or circular member connected to the other shoulder strap and provided with a hook engaging the first member so that the straps can be joined in an X pattern when desired. The hook projects inwardly substantially to an extension of the inner periphery of the second member and in any event lies inwardly of an extension of the outer periphery of the inner member.

17 Claims, 5 Drawing Sheets

FIG. 1
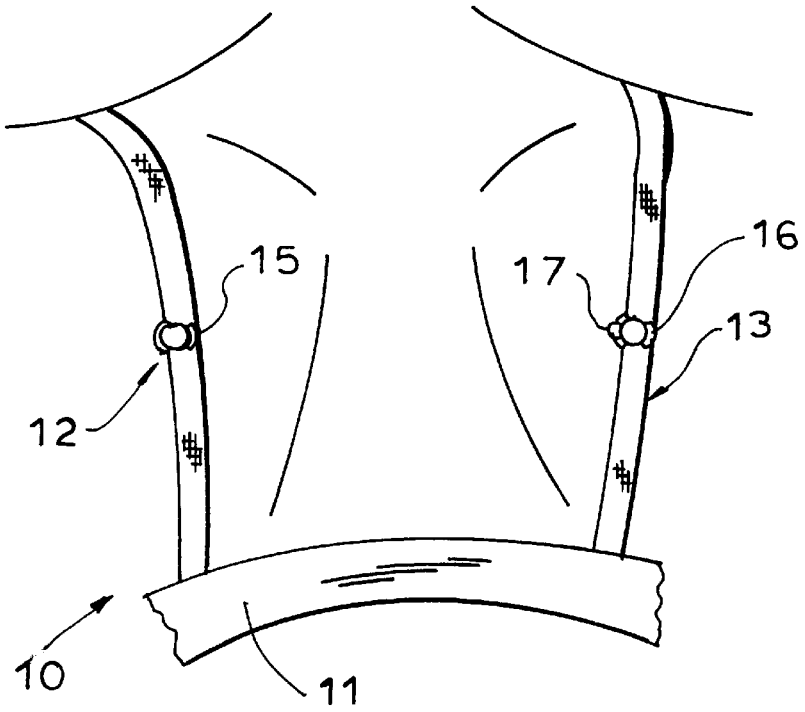
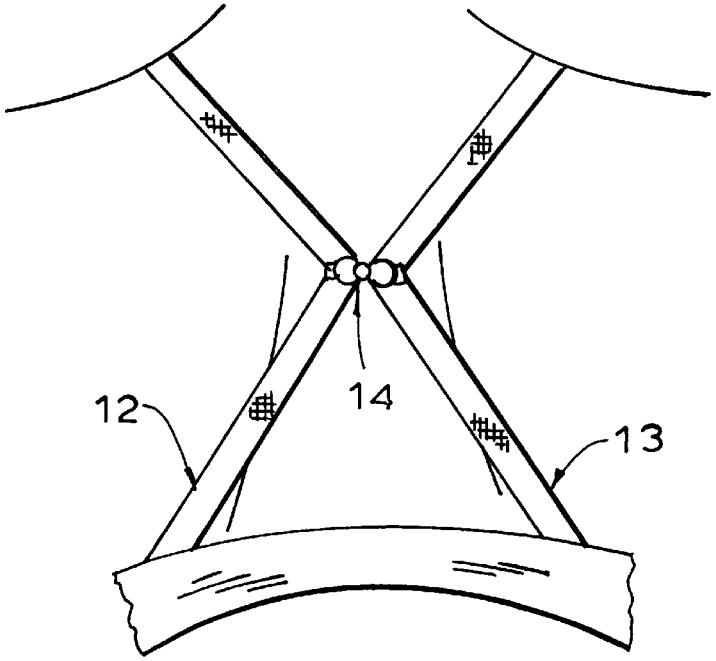
FIG. 2

FIG. 5
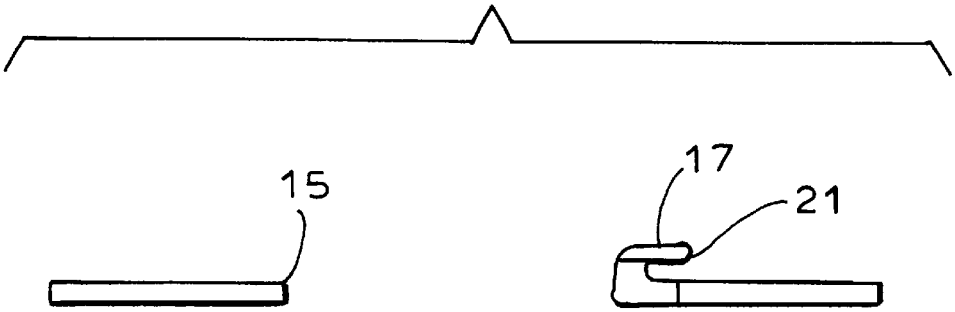
FIG. 4
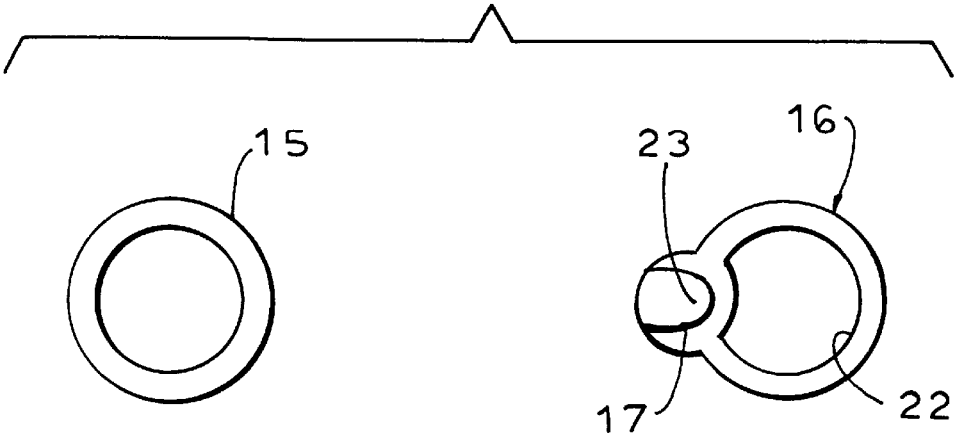
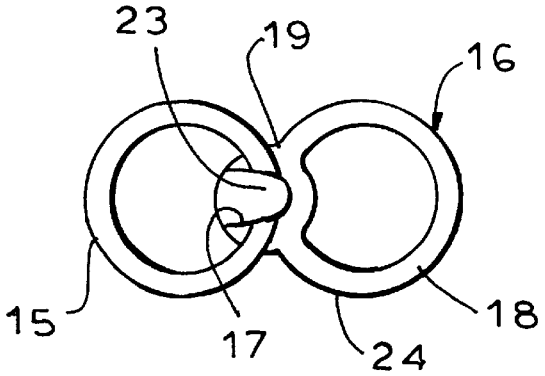
FIG. 3

FIG. 13
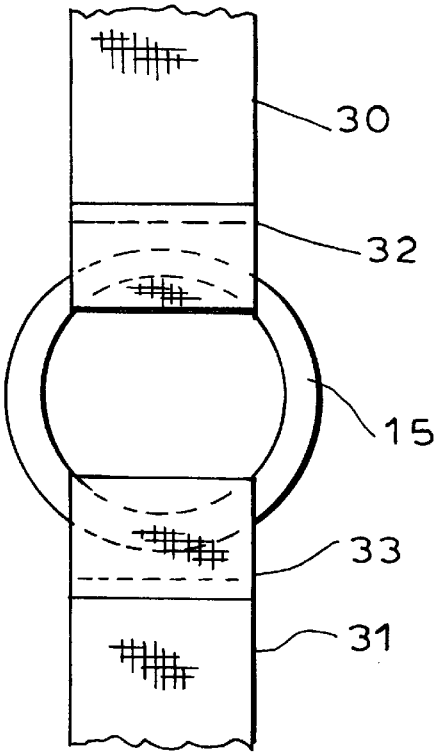
FIG. 14
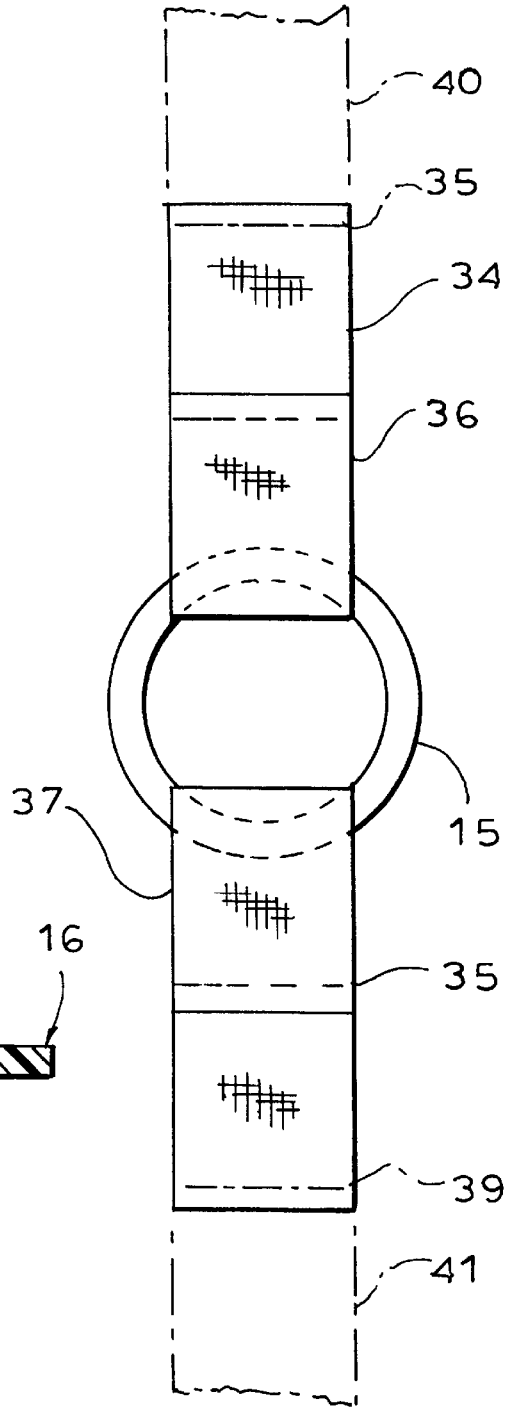
FIG. 10
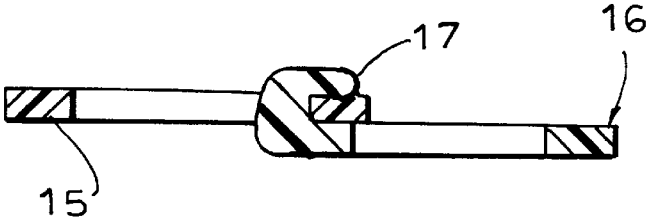
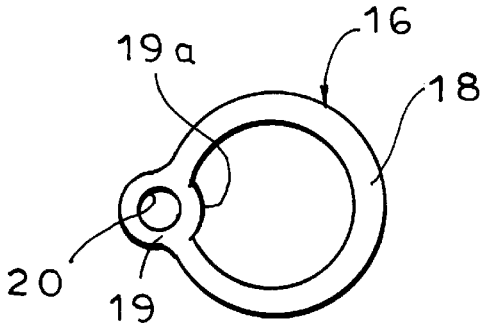
FIG. 6

SHOULDER STRAP CONNECTOR FOR BRASSIERES, LINGERIE AND BATHING SUITS

FIELD OF THE INVENTION

The present invention relates to a shoulder strap connector for brassieres, lingerie, bathing suits and like garments and intended to interconnect releasably two garment shoulder straps.

BACKGROUND OF THE INVENTION

In certain garments, such as brassieres, lingerie and bathing suits, a pair of shoulder straps reach from the rear of the garment over the shoulders of the wearer to the front of the garment. These shoulder straps may have adjustable or fixed effective lengths and can be provided on any kind of garment, most notably brassieres, lingerie and bathing suits.

Other shoulder strap arrangements, however, can also be used including those in which the straps cross one another at the rear of the garment or the two shoulder straps are connected at the rear of the garment between the shoulder of the wearer and the locations at which the straps are affixed to the back of the garment. Frequently, the wearer desires to have the option of having the shoulder straps connected at the back or not so connected and there has not been, as far as I am aware, any effective means of doing so without, for example, pinning the two straps together or providing relatively complex and unesthetic connections between the straps.

OBJECTS OF THE INVENTION

It is, therefore, the principal object of the invention to provide an improved shoulder strap connector which affords the advantage of interconnection of two shoulder straps or the disconnection thereof in a sample and esthetic manner, whereby drawbacks of earlier shoulder strap connection techniques are avoided.

It is also an object of the invention to provide a garment, the shoulder straps of which can be releasably connected in an esthetic and simple manner.

SUMMARY OF THE INVENTION

These objects and others which will become apparent hereinafter are attained in accordance with the invention, with the aid of a shoulder strap connector which comprises an annular member connected to one shoulder strap of a garment and a further annular member connected to the other shoulder strap of a garment, one of these members being formed with a hook while the other is engageable by the hook to enable the two members to be secured together. Advantageously, the members may be circular or elliptical or oval in configuration, can be fitted with intermediate bars over or under which the strap can pass to enable the member to be adjusted along the strap, or connected to the strap by fabric loops.

Advantageously, the hook can engage over an arcuate portion of the other member which can be received between an overhanging portion of the hook and the underlying portion thereof so as to be clamped releasably in the hook.

Alternatively, the hook can be fitted into an eye which is formed on the hook-engaging member.

According to another feature of the invention, a detent can be provided on the hook which can engage over the hook receiving member or engage in a recess formed in the hook receiving member.

In either case, a spring lock engagement of the hook with the hook-receiving member is formed.

BRIEF DESCRIPTION OF THE DRAWING

The above and other objects, features, and advantages will become more readily apparent from the following description, reference being made to the accompanying drawing in which:

FIG. 1 is a diagrammatically elevational view showing a garment having shoulder straps equipped with the shoulder strap connector of the invention, the members of the connector being disconnected;

FIG. 2 is a view similar to FIG. 1 showing the interconnection of the two members;

FIG. 3 is an elevational view of the connector in accordance with a first embodiment of the invention;

FIG. 4 is an exploded view thereof;

FIG. 5 is a view of the two members separated and seen from the bottom;

FIG. 6 is a rear view of the male connector of FIGS. 3 through 5, drawn to a larger scale;

FIG. 10 is a sectional view through a connector of the invention showing the hook engaged, e.g. for the connector of FIGS. 3 through 6;

FIG. 13 is an elevational view showing a connection of one of the members to a strap; and FIG. 14 is a view similar to FIG. 13 but showing another embodiment of the invention.

SPECIFIC DESCRIPTION

As can be seen from FIG. 1, a garment 10 such as a bathing suit, or an article of lingerie, or a brassiere, can have a back piece 11 and a pair of shoulder straps 12 and 13 reaching from the back piece 11 over the shoulder of the wearer.

Figure 9:
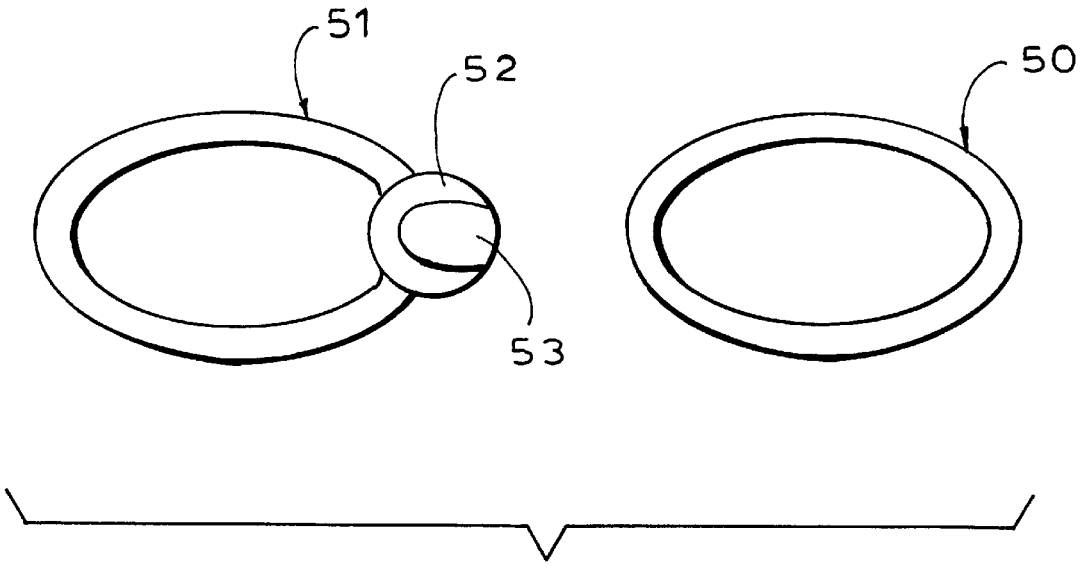
FIG. 9 is an exploded view of a third embodiment of the invention.

As can be seen from FIGS. 1 and 2, a connector 14 comprised of a first member 15 and a second member 16 can be provided along the straps 12 and 13 so that, in the disconnected state of the members (FIG. 1), the straps are more or less parallel to one another. The second member 16 has a hook 17 engageable in the first member 15 (FIG. 2) to drawing the 2 straps together and from an interconnection of the straps analogous to that obtained when the straps crossed or are permanently joined together in the form of an X. As can be seen in greater detail from FIGS. 3 through 6, the member 15 can be a circular ring while the hook 17 can be unitarily formed on the member 16 which can have a generally circular portion 18 formed with a projection 19 which, as seen in FIG. 6, is of generally circular outline and is provided with a circular hole 20 overhung by the hook 17. The hook 17 is turned inwardly and has an inner extremity 21 which lies substantially in an extension of the inner periphery 22 of the annular portion 18. In any event the hook should terminate inwardly of an annular extension 23 of the outer periphery 24 of the member 18. In the case of the embodiment of FIGS. 3 through 6, these extensions are circular arcs, whereas in the embodiment of FIG. 9, the extensions will be arcs of an ellipse or oval symmetrical to the arcs of the inner and outer peripheries of the oval or ellipse on the opposite side from the projection 19. As can be seen from FIG. 10, the hook 17 can engage over the generally flattened ring 15. On the members 15 and 16, substantially all corners and edges are founded to prevent irritation of the wearer or damage to fabric in wearing or laundering.

For a connector of the type shown in FIGS. 3 through 6 and 10, in which the inner periphery of the members 15 and 16 have diameters of about 9 mm, the outer diameters can be 12 mm and hence the width of the ring in each case can be 1.50 mm. The overall length of the connector 16 can be, say, 15 mm and the thickness of the annular portions of the member can be 1.30 mm and the total height of the hook portion can be 3.60 mm. Similar portions are maintained for different sizes of the connector which can have internal diameters of 11 or 14 mm depending upon the strap width. For wider straps, the oval or elliptical configuration can be provided and, of course, one of the numbers can be circular while the other is oval or elliptical as may be desired.

As can be seen from FIG. 13, strap ends 30 and 31 can be looped around the ring 15 or through the annular portion 18 of a member 16 and stitched along stitching lines 32 and 33. The connector can be received with play in the respective loops to allow the straps to assume the orientation shown in FIG. 2. In the embodiment of FIG. 14, each member, e.g. the member 15 shown in this FIG., is marketed with a fabric portion 34, 35 with loops 36 and 37 which can be stitched along stitching lines 38 and 39 to the strap ends 40 and 41.

Figures 7, 8:
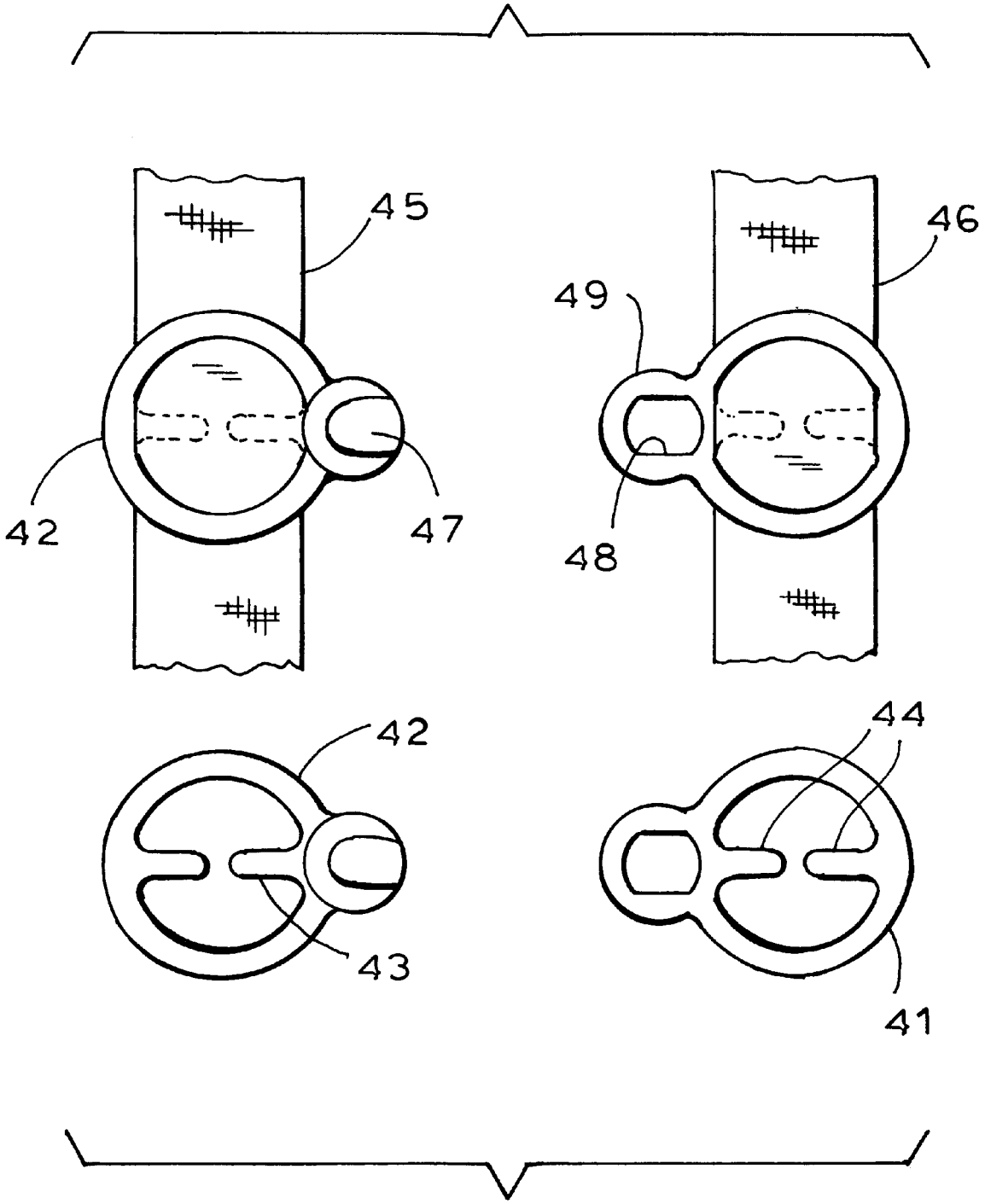
FIG. 7 is an exploded view of a second embodiment.
FIG. 8 is a view of the connector of FIG. 7 on respective straps.

From FIG. 7 it will be apparent that members 41 and 42 can also be equipped with inwardly extending bars 43 and 44, between which the strap can be inserted so that the straps 45 and 46 can pass through the members and over the bars (section 8). In this embodiment, the hook 47 can engage in an eye 48 on a projection 49 of the member 41.

In an alternative to the configuration shown in FIGS. 3 through 6, the 2 members 50 and 51 can be oval or elliptical. Here the circular projection 52 on member 51 is provided with the hook 53 as in the embodiment of FIGS. 3 through 6, the hook engaging the oval member 50.

Figure 11:
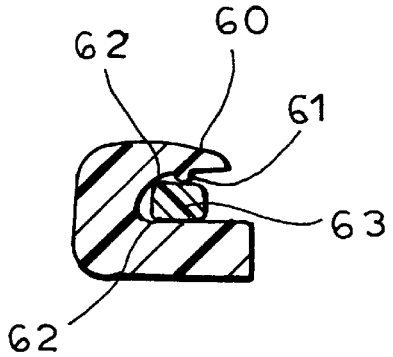
FIG. 11 is a sectional view of a hook arrangement provided with an additional detent.

As can be seen from FIG. 11, a hook 60 as has been described can be formed with a ridge 61 engageable in a recess 62 formed in the ring 63 to provide a snap fit for better rotation of the member 63 in the hook.

Figure 12:
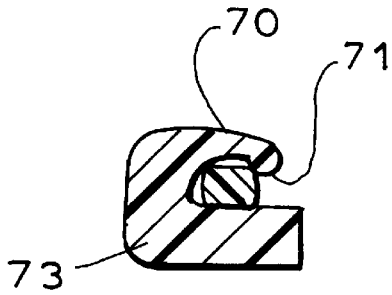
FIG. 12 is a view similar to FIG. 11 of another embodiment.

A similar snap fit can be provided by forming the hook 70 (FIG. 12) with a downwardly and inwardly turned projection 71 engageable over the ring 73.

The male member can have an oval ring forming the projection in any of the embodiments previously described and in all of the embodiments other than that of FIGS. 7 and 8, the hook can be rotated beneath the strap on which it is mounted when the two members are not engaged with one another. The arc 19*a* assists in retaining the hook member in position beneath the strap.

I claim:

1. A shoulder-strap connector for a garment having two shoulder straps, said connector comprising an annular first member connectable to one of said shoulder straps, and an annular second member connectable to the other of said shoulder straps and formed with a circular lateral projection and a hook overhanging said projection and molded unitarily therewith, turned inwardly and releasably engageable with said first member for interconnection of said shoulder straps, said hook having a free end lying inwardly of an arc smoothly continuing an outer periphery of said second member through said lateral projection but not extending inwardly past an arc smoothly continuing an inner periphery of said second member through said lateral projection said projection bulging inwardly at said inner periphery.

2. The shoulder-strap connector defined in claim 1 wherein said first member is a circular ring.

3. The shoulder-strap connector defined in claim 1 wherein said first member is an oval ring.

4. A shoulder-strap connector for a garment having two shoulder straps, said connector comprising an annular first member connectable to one of said shoulder straps, and an annular second member connectable to the other of said shoulder straps and formed with a lateral projection and a hook overhanging said projection, turned inwardly and releasably engageable with said first member for interconnection of said shoulder straps, said hook having a free end lying inwardly of an arc smoothly continuing an outer periphery of said second member through said lateral projection but not extending inwardly past an arc smoothly continuing an inner periphery of said second member through said lateral projection, said lateral projection being a ring.

5. The shoulder-strap connector defined in claim 4 wherein said second member includes a generally circular ring formed with said projection.

6. The shoulder-strap connector defined in claim 4 wherein said second member includes a generally oval ring formed with said projection.

7. The shoulder-strap connector defined in claim 4 wherein said first member is formed with an eye receiving said hook.

8. The shoulder-strap connector defined in claim 4 wherein said first and second members each have a pair of strap ends looped there around and stitched to retain the respective member in respective loops.

9. A shoulder-strap connector for a garment having two shoulder straps, said connector comprising an annular first member connectable to one of said shoulder straps, and an annular second member connectable to the other of said shoulder straps and formed with a lateral projection and a hook overhanging said projection, turned inwardly and releasably engageable with said first member for interconnection of said shoulder straps, said hook having a free end lying inwardly of an arc smoothly continuing an outer periphery of said second member through said lateral projection but not extending inwardly past an arc smoothly continuing an inner periphery of said second member through said lateral projection, a pair of inwardly extending bars being formed on each of said members along respective diameters thereof in line with said hook to enable respective straps to pass over the respective bars for adjustment of said members along said straps.

10. An article of lingerie having a pair of shoulder straps and a shoulder-strap connector for optionally connecting said shoulder straps together, said shoulder-strap connector comprising an annular first molded plastic member connected to one of said shoulder straps, and an annular second molded plastic member connected to the other of said shoulder straps and formed with a lateral projection and a hook overhanging said projection and molded unitarily therewith, turned inwardly and releasably engageable with said first member for interconnection of said shoulder straps, said hook having a free end lying inwardly of an arc smoothly continuing an outer periphery of said second member through said lateral projection but not extending inwardly past an arc smoothly continuing an inner periphery of said second member through said lateral projection, said hook being formed with a ridge resiliently engaging said first member to retain said members together, said first member being formed with a recess, said ridge engaging in said recess.

11. The article of lingerie defined in claim 10 wherein said members are generally circular rings.

12. The article of lingerie defined in claim 10 wherein said members are generally oval rings.

13. An article of lingerie having a pair of shoulder straps and a shoulder-strap connector for optionally connecting said shoulder straps together, said shoulder-strap connector comprising an annular first member connected to one of said shoulder straps, and an annular second member connected to the other of said shoulder straps and formed with a lateral projection and a hook overhanging said projection, turned inwardly and releasably engageable with said first member for interconnection of said shoulder straps, said hook having a free end lying inwardly of an arc smoothly continuing an outer periphery of said second member through said lateral projection but not extending inwardly past an arc smoothly continuing an inner periphery of said second member through said lateral projection, said lateral projection being a circular ring and being formed with a circular hole therein.

14. The garment defined in claim 13 wherein said first member is formed with an eye receiving said hook.

15. The garment defined in claim 13 wherein said first and second members each have a pair of strap ends looped therearound and stitched to retain the respective member in respective loops.

16. The garment defined in claim 13 wherein a pair of inwardly extending bars are formed on each of said members along respective diameters thereof in line with said hook to enable respective straps to pass over the respective bars for adjustment of said members along said straps.

17. The garment defined in claim 13 wherein said hook is formed with a ridge resiliently engaging said first member to retain said members together.

* * * * *